United States Patent [19]

Doster et al.

[11] Patent Number: 4,967,626

[45] Date of Patent: Nov. 6, 1990

[54] APPARATUS FOR SECTIONING TIRE CARCASSES

[76] Inventors: John Doster; Joe W. Barnett; Jimmy Barnett, all of P.O. Box 516, Nettleton, Miss. 38858

[21] Appl. No.: 279,349

[22] Filed: Dec. 2, 1988

[51] Int. Cl.[5] ..... B26F 1/14

[52] U.S. Cl. ..... 83/124; 83/176; 83/385; 83/620; 83/682; 83/687; 83/923

[58] Field of Search ..... 241/DIG. 31; 157/13; 83/923, 175, 176, 639, 123, 124, 133, 382, 385, 620, 621, 622, 682, 687, 691, 569

[56] References Cited

U.S. PATENT DOCUMENTS

| | | | |
|---|---|---|---|
| 3,217,574 | 11/1965 | Nauta et al. | 83/176 X |
| 3,826,166 | 7/1974 | Hemmings | 83/620 X |
| 4,276,800 | 7/1981 | Koppa et al. | 83/682 |
| 4,338,840 | 7/1982 | Farrel, Sr. et al. | 83/639 X |
| 4,355,556 | 10/1982 | Ulsky | 83/124 |
| 4,694,716 | 9/1987 | Sakamoto | 83/923 X |

FOREIGN PATENT DOCUMENTS

| | | | |
|---|---|---|---|
| 2939849 | 4/1981 | Fed. Rep. of Germany . | |
| 0022117 | 7/1978 | Japan | 83/620 |

*Primary Examiner*—Frank T. Yost
*Assistant Examiner*—Rinaldi Rada
*Attorney, Agent, or Firm*—Alexander Norcross

[57] ABSTRACT

A mechanism for cutting a tire carcass into small sections for disposal. An array of adjoining female die sections has knife edges forming the sides of each die and shearing sections forming the corners of each die. Matching, shearing fit male punches opposingly face each die and material clasping anvils extend through each die facing the punches. A tire carcass is placed between the anvils and the punches. The anvils and punches are actuated against each other clamping the tire carcass. Punch pressure overrides the opposing anvil pressure, driving the combination of anvil, carcass and punch through the die. The forward extending knife edges penetrate the rubber of the carcass, shearing the rubber as the carcass is held taut between the anvils and the punches. The punches then proceed through the die, shearing the reinforcing cords against the corner shearing sections. The clamping action of the anvils and punches substantially prevents the carcass from escaping the cutter. The two part cutting action which cuts the rubber and then shears the reinforcing cords substantially reduces the resistance of the carcass to cutting. The mechanism will cut steel reinforced tire carcasses with minimal effort and without hogging or jamming.

10 Claims, 3 Drawing Sheets

APPARATUS FOR SECTIONING TIRE CARCASSES

BACKGROUND OF THE INVENTION

The instant invention is in the field of tire shredding cutter mechanisms.

The closest prior art to this invention is believed to be U.S. Pat. No. 4,694,716 to Sakamoto. Sakamoto discloses a tire shredding apparatus involving the capture of tire carcasses between two opposing plates, a bottom fixed plate and an upper presser plate, through which are projected a plurality of cutter blades. The cutter blades retractably project through slits in the presser plate, between the blades and the tire carcasses. The particular design in this machine is to produce radially shaped pie cuts or sections of the tire, and it includes a mechanical moving plate for clearing the cutter blades of tire sections.

U.S. Pat. No. 3,517,580 to Sturm, discloses a removable punching chisel, in which the mounting is designed so as to adapt and facilitate the mounting of a knife edge on a punch die.

U.S. Pat. No. 3,320,843 to Schott, discloses a self-aligning knife edge chisel for punching holes; Schott uses the tapered angle of the chisel together with a spring mount on the punch blade to align the chisel into a receiving hole.

U.S. Pat. No. 3,314,271 to Otis, discloses a punch press in which a plurality of knife edge blades having a shearing edge are shown for receiving and punching sheet metal.

U.S. Pat. No. 3,589,221 to Deegan shows the use of punch dies for shearing relatively resistant metal structures. In this patent, a large rectangular punch is disclosed having two shearing faces, numbers 26 and 25, which shear a metal sheet (10) against a receiving hole structure (29, 30).

U.S. Pat. No. 4,338,839 to Farrell, discloses a ram cutter in which a set of relatively large tapered, angled blades in a single acting cylinder ram shear the tire carcass. FIG. 6 shows the blades shear against a cooperating structure.

U.S. Pat. No. 4,338,840 to Farrell, shows a similar hydraulic ram tire shearer in which a series of radially disposed shearing blades cooperate with a fixed structure for the purpose of shearing the carcass into large radial sections.

U.S. Pat. No. 4,576,339 to Snyder discloses a typical rotary blade tire cutter in which a series of rolling blades react against a cylindrical anvil roll for cutting the tire in segments between the rollers.

SUMMARY OF THE INVENTION

The present invention is a cutter for disposing of tire carcasses producing uniform sized tire pieces which are then particularly suitable for fuel stock for boilers.

The machine consists of a matrix of opposing anvil and punch pieces, in the form of round cornered squares. The first, anvil pieces protrude through a female die formed of matrix of knives. The exact shape of the knife edges is still experimental, but basically each of the knives is triangular in shape, and the more successful ones appeared to resemble shark teeth, although some blunt edged knives may hold up better under the abrasiveness of a tire carcass.

The first set of anvils is driven to an extended position above the level of the knife edges by a driven hydraulic cylinder having a first, lower pressure. Directly opposed to and facing each of the anvils is a matching punch, again in a matrix, driven by a hydraulic pressure source having a lower actuation speed but a much greater, second pressure. The round corners of each of the punches exactly mate, as shearing edges, with provided rounded cutting edge corners at the intersection where each of the knife blades meet. Since the knife blades are in the form of a lattice having both vertical and horizontal blades, the lattice forming the outer perimeter of the female dies enclosing the anvil faces, it is the vertices of the lattice which form the rounded cutting edges.

In use, the anvils are activated. The anvils move with some swiftness to a position above the point of the knives. The tire carcass is then placed into the open space between the anvils and punches and the anvils are actuated. The punches, closing upon the anvils, flatten and squeeze the tire to a rigidly clamped position. The increased hydraulic force then drives the anvils against the first pressure, driving the knives through the carcass of the tire, cutting the tire initially into uniformly sized square pieces, each the size of an anvil. The bead and reinforcing wires of the tire, which contain steel cables up to a bead cable roughly equivalent to a $9\times16$ strand of stainless steel cable, cannot be cut by the knives. The bead therefore slides down on the knife edges to the intersecting corner section. The force on the hydraulically driven punches then catches the bead of the tire between adjoining lattice vertices and shears the bead cable by the action of the shearing edge.

The punches then drive to a further depth shearing the lattice structure of the tire and completing the cutting.

The hydraulic pressure is then reversed and the punches are withdrawn; the anvils, still under the first pressure drive outward, clearing the knives and cutting sections of the tire pieces, which fall below.

The machine has been tested in a prototype configuration having nine anvils in a $3\times3$ matrix working on tire carcass sections. The machine readily cuts the tire in single passes into uniform square sections having the same dimensions as the anvils. There was no jamming or hogging of the machine. The noise level was quite low and there was absolutely no vibration.

Although goggles were worn at the time, there appears to be little problem with flying debris since the cut sections are all enclosed between the anvils and the punches save for an outer matrix section.

The tire was a steel belted tire but was readily cut.

DETAILED DESCRIPTION OF THE PREFERRED EMBODIMENT

Figure 1:
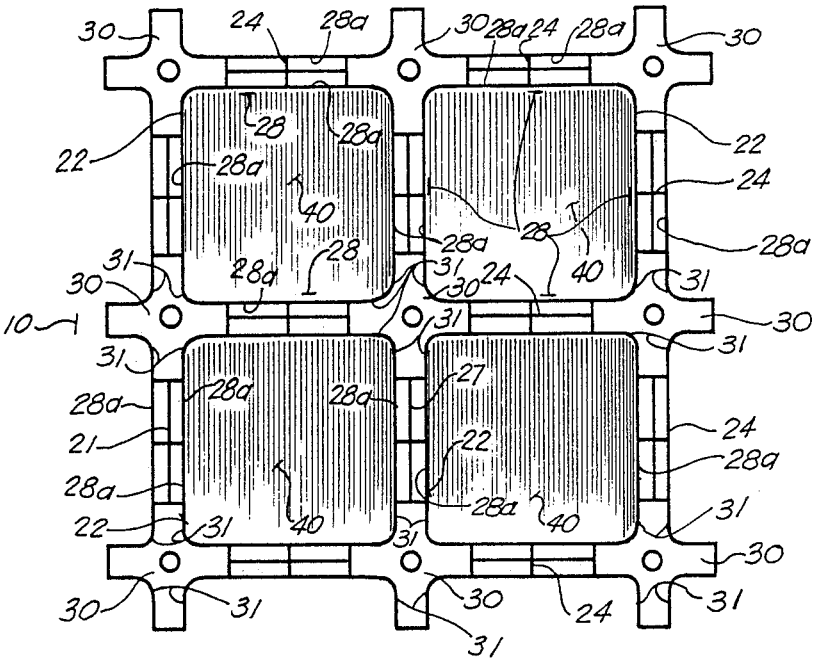
FIG. 1 is a facing view of a matrix of the female die assembly of the invention.
Figure 2:
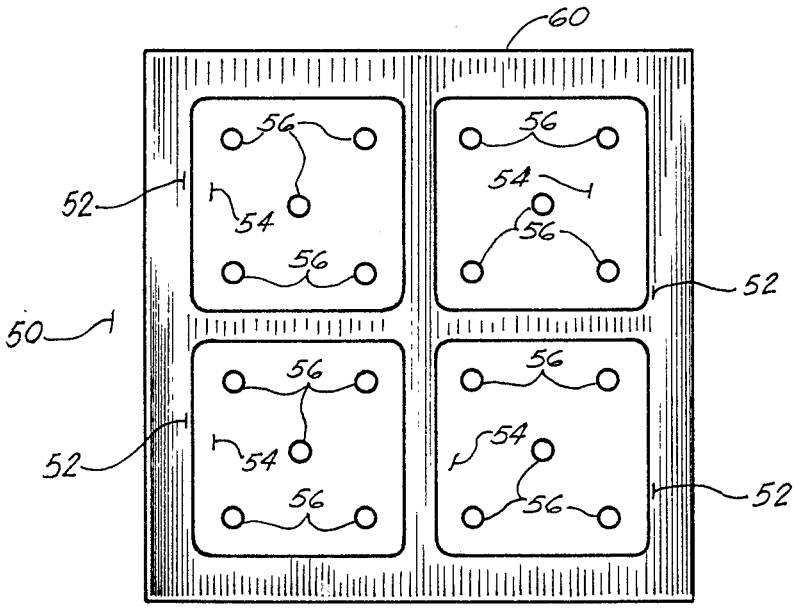
FIG. 2 is a facing view of a matrix of the punch assembly of the invention.
Figure 3:
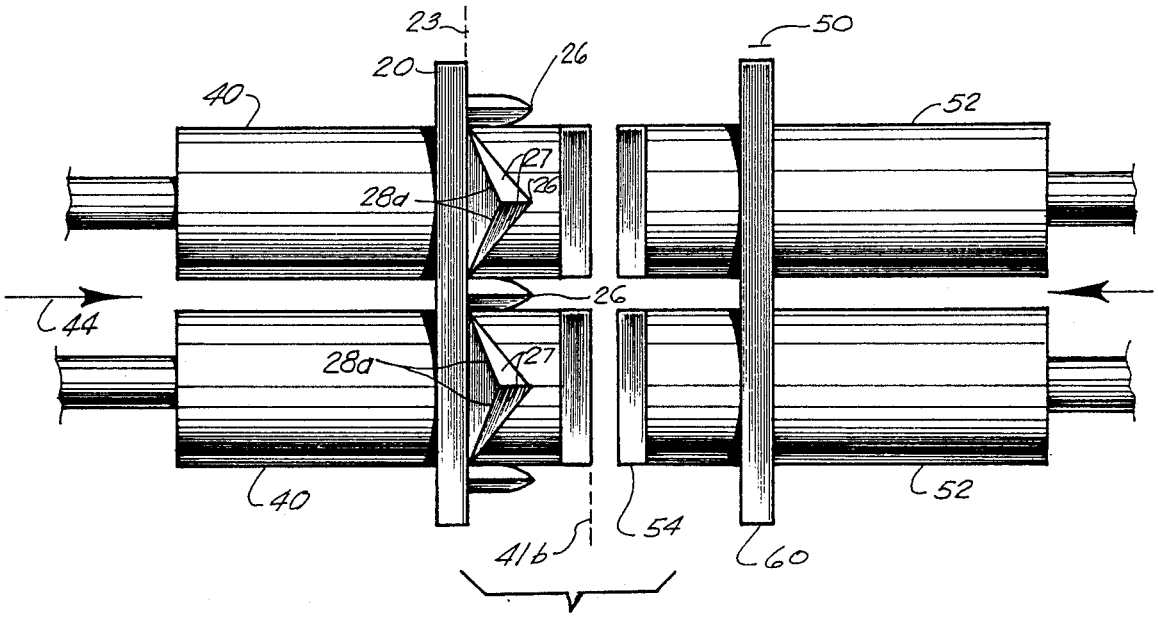
FIG. 3 is a side exemplar view of the invention.
Figure 4:
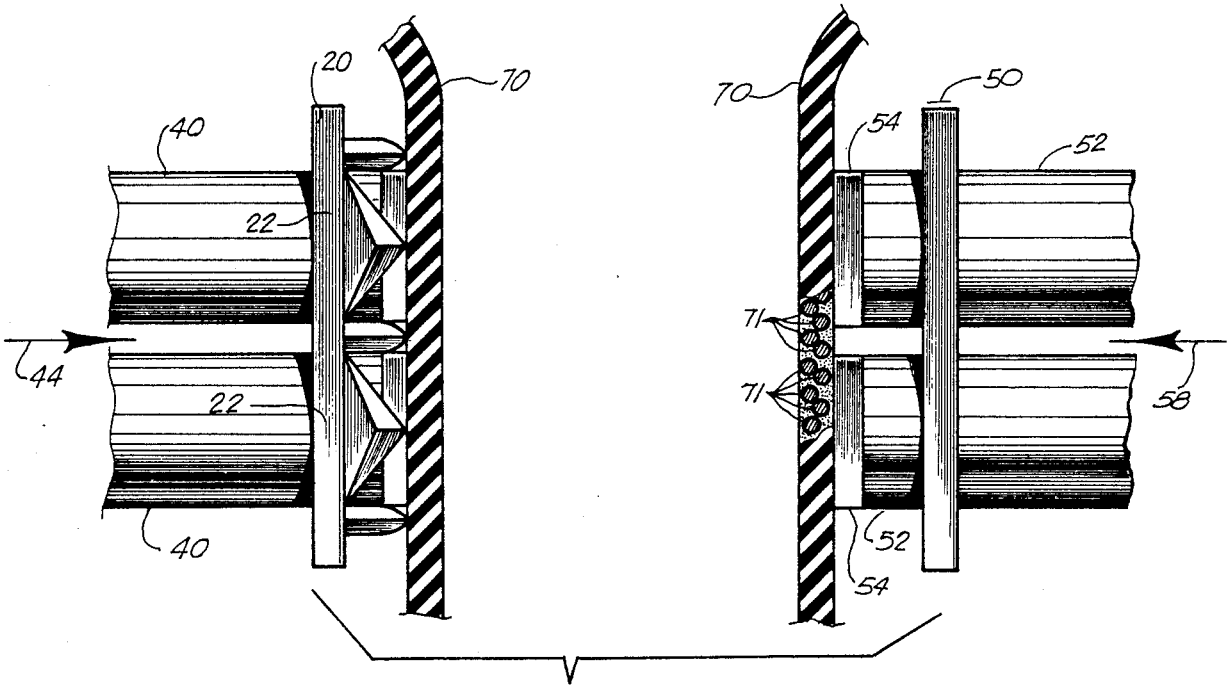
FIG. 4 is a side view of the invention with the tire carcass inserted therein.
Figure 5:
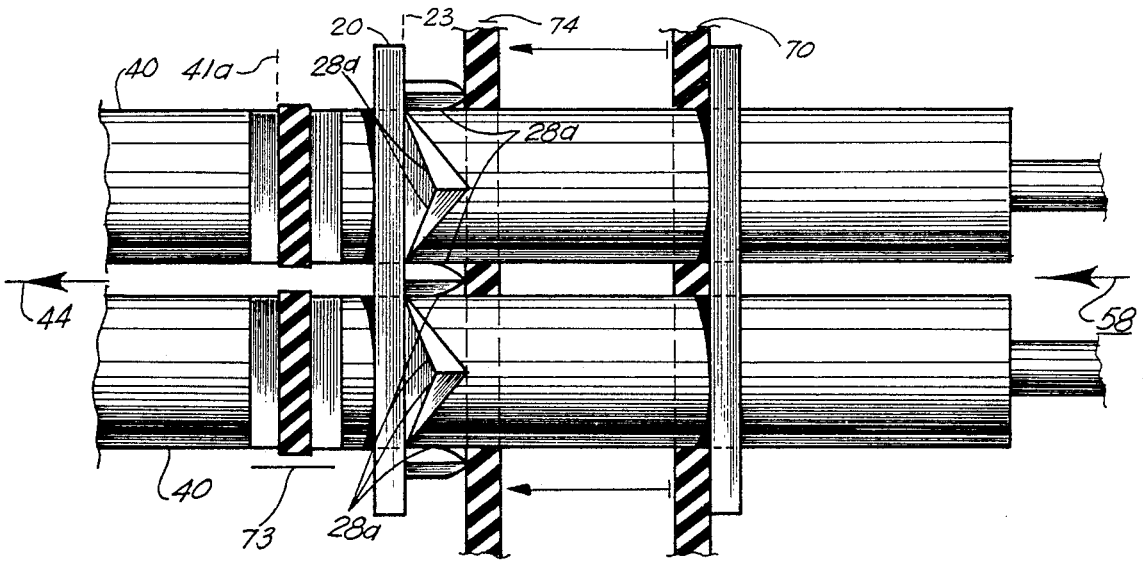
FIG. 5 is a side view of the invention upon activation of the dyes.
Figure 6:
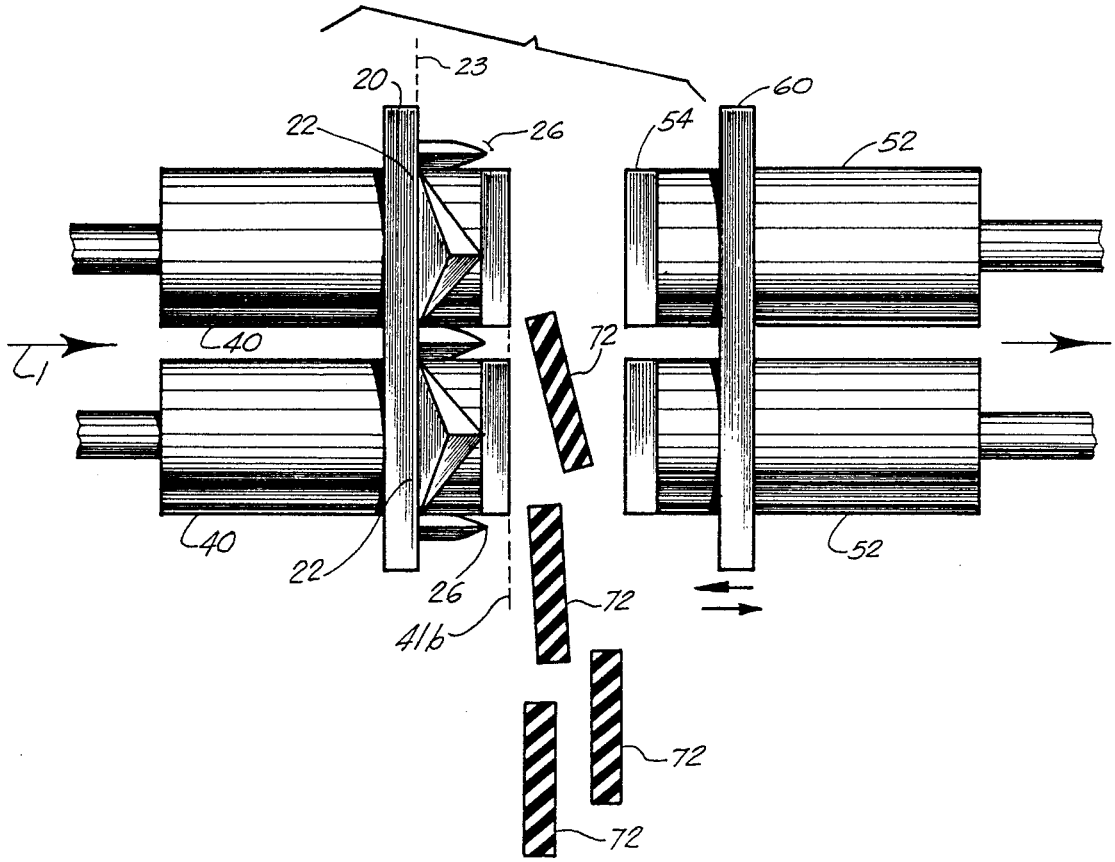
FIG. 6 is a side view of the invention showing ejection of the cut carcass pieces.

Referring to the figures, the inventive cutter die mechanism 10 is shown to consist of facing, opposed sections. The first section is the female die assembly 20 of the invention which may be built in the form of a matrix of a suitable size for the items to be cut, but in the exemplary description here given is shown as a matrix of four cutter sections for the purpose of illustration. It will be apparent to a person of skill in the art from the description which follows how this matrix may be expanded as desired to provide an overall cutter assembly 10 of suitable size for any particular carcass to be disposed of as cutting pieces.

Female die assembly 20 is composed of a matrix of essentially square die sections 22. Each female die section 22 is built having four knife edge sides 24. Knife edge sides 24 are single point, upwards extending, tooth shaped knives having an upward point 26 and having sharpened cutter edges 27 descending at an angle from point 26 towards the face 23 of the die. Each knife edge side 24 forms the cutter side 28 for each square die 22. As a result, within a matrix of dies 22 the knife edges 24, in descending towards face plane 23 of the die face, create an angled entry to button cutter 30, preferably a hardened cutting insert, as known to the machinis's art, which define the vertices or corners of each die 22.

Button cutter 30 is a hardened insert defining shearing edges 31, which are preferably of a curved shape defining a smoothly curved corner for each of the dies 22.

The adjacent cutter sides 28 and button cutter inserts 30, in forming female die 22, form a matrix of round cornered substantially square die opening in the embodiment shown. It should, however, be apparent that the shape of cutter die 22 may be that of any regular geometric figure capable of creating a repeated pattern or matrix of female dies 22 to create an entire die assembly 20. Thus, triangles or any other regular geometric figure capable of dense packing, as known to the art, would be a suitable form, and all description herein referring to rectangles and squares should be interpreted as exemplary and not as limiting.

The female die openings within the matrix of the female die assembly 20 may be extended to form cylindrical sleeves. Whether this is done, within each female die 22 is aligned a movable material clasping or clamping anvil 40, of a shape conformable to that of die 22. In the described embodiment, anvil 40 is essentially rectangular in cross section having a flat face. Each anvil 40 is laterally movable through female die 22 extending from a withdrawn position 41*a* to a extended position 41*b*, withdrawn position 41*a* being behind die 22 and extended position 41*b* being such that anvil 40 is beyond the upper limit of the outwardly extending knife edge points 26.

In the preferred embodiment, anvils 40 are driven by first hydraulic pressure 44, defining a first maximum driving force to anvils 40. Whether hydraulically driven or driven by other means, anvils 40 should be driven by a source of power that provide a constant, high closing pressure on the anvils 40. The driving means, however, must not involve any form of mechanical lock against rearward motion, and anvils 40 must be capable of rearward motion, while being driven, when a higher pressure or reverse driving load is encountered.

Facing die 22 and anvils 40, and aligned facingly against each anvil 40, is a male punch assembly 50 comprising an array of rectangular faced punches 52, on a one to one relationship with the anvils 40. Each rectangular faced punch 52 has a cutter face insert 54 of a suitably hardened cutting face material, as is known in the material cutting art, fastened to the punch 52 by screw attachment 56. The shape and size of each cutter face insert 54, and preferably of punches 52, is such as to provide an interference or cutting match fit to each female die 22.

Punch assembly 50 is supported and arranged so that, in forward extension, each of the punches 52 exactly fits into and passes through a female die 22.

Each of the punches 52 is also in the preferred embodiment hydraulically driven by a second hydraulic pressure 58 greater than the first pressure 44 driving the anvils 40. This hydraulic driving force must be of independent control from the control of the hydraulic force driving the anvils 40.

Enclosing the matrix of punches 52, and, preferably forming part of the support aligning the punches 52 with the respective dies 22, is a stripper plate assembly 60, a smooth closed plate enclosing each of the punches 52, aligning a facing matrix of punches 52 facing the female die assembly 20.

In use, the cutter assembly as described is of particular utility for cutting a reinforced flexible material, most notably the carcass of a standard reinforced automobile or truck tire.

As is known in the art, tire carcasses 70 are made of a reinforced construction having a plastic, deformable and very tough matrix material, such as a cured rubber, enclosing and being enforced by a web of reinforcing cables 71 which may be any tensilly strong material, but in common practice is often steel cable.

For any given tire carcass 70, the carcass is placed between the facing, opposed female die assembly 20 and male punch assembly 50.

Independent activation of first hydraulic pressure 44 drives the anvils 40 against tire carcass 70. First hydraulic pressure 44 must be of a strength sufficient to collapse and grasp the tire carcass against the punches 52 forming a locked unitary structure 73 supported by the strength of first hydraulic pressure 44.

Independent activation of second hydraulic pressure 58, which by design is of greater than first hydraulic pressure 44 collapses the carcass 70 between anvils 40 and punches 52, and then drives the anvils 40 and the tire carcass 70 back into die assembly 20. The assembly 73 of anvil, tire carcass and punch is held together by the opposing force of first hydraulic pressure 44. The tire carcass 70, being crushed between anvil 40 and punch 52 is carried and driven through die 22 with the strength of the greater hydraulic pressure 58.

The actual construction of female die 22 as described above creates a multiple cutting effect on tire carcass 70 as punch 52 drives through die 22.

At first contact, knives 24 penetrate carcass 70 holding each section of carcass 70 essentially as a taut section across the open face of a die 22 against the force of a punch 52. The knife points 26 penetrate into the flexible matrix; the knife edges 27 are sufficient to penetrate and cut at least the non-reinforced sections or the more weakly reinforced sections of the carcass 70. Knives 24 additionally hold locally tensioned square sections over the die face 22. Any reinforcing cord 71, such as the steel cords in the tire bead edge, which is not cut by knives 24 will slide down along knife edge 27, directed by the angle of knife edge 27 to the button cutters 30.

Hardened facing insert 54 on punch 52 then shears these reinforcing cords against the button cutters 30, the remainder of the tire having previously been sheared against the lower knife edges 28*a*. The combined two stage effect of punch 54 driving the tensioned sections of tire carcass 70 first against knives 24 and then secondly, against button cutters 30 shears tire carcass 70 into square sections 72.

It is felt that the two step cutting process, wherein the matrix is first held and partly separated by shearing effect between the sides of punch faces 54 and knife edge blades 24, before the shearing of the remaining reinforcing cords between facings 54 and button cutters 30, provides for an even successful cut. Apparatus that simultaneously shear both the matrix and the reinforcing cords have proven unsatisfactory in that the matrix resists a shearing cutter by driving the shearing cutter pieces apart, while the reinforcing cords are capable of resisting any knife edge sharp enough to penetrate into the matrix.

This is of course, a deliberate result of the design of tire carcasses, which are intended to resist the very types of cutting forces necessary to cut up and dispose of a used carcass.

The two step shearing process of the innovative cutter assembly having removed and rendered most of the tire carcass into uniform size squares, the second, greater hydraulic pressure 58 is then released and the punch anvils under the continuing influence of first hydraulic pressure 44 force the cut square section 72 out from within die 22. The first hydraulic pressure clamps these squares against punches 52 to the full extent of extension of anvils 40.

It is to be noted that the dual cutting effect imposed by the knives of die 22 slightly stretches each section of tire carcass prior to the cutting of square section 72. As soon as square sections 72 have been fully cut and sheared from the tire carcass, the release of tension causes the square sections to slightly shrink, reducing their dimensions below that of the opening dimension of die 22, and thus essentially eliminating any binding or jamming which might otherwise interfere with the ejection of the individual cut pieces 72 from within die 22.

The same release of tension causes the remaining carcass section 74, which at this point resembles an open, sparse web having large square holes and very thin edge sides, to shrink from the stretching effect imposed by the cutting. This causes the web to grip the individual punches 52. This residual web 74 may be removed either by withdrawing the punches 52 through stripper plate 60, or, alternatively, stripper plate 60 may be independently made movable and may be extended to the end of punches 52, stripping off the web.

The residual web 74 is an artifact of the particular cutter geometry, resulting primarily from the width of the button cutters shown, but retains little of the strength of a tire carcass due to the shearing of substantially all of the reinforcing cords by the first cut. Therefore, in practice it has been found that the residual web can be readily cut into small pieces by simply including it with a second tire carcass 70 when the machine is cycled for another cut.

The invention as described is of a particular cutter mechanism which is capable of more readily rendering a reinforced tire carcass easily into relatively uniform pieces, which is known in the art to be advantageous for recycling or disposal of used tire carcasses.

The geometry and structure of the cutter prevents the deflection and jamming inherent in the prior art tire carcass cutters which attempt simultaneously to shear both matrix and reinforcing cord thus attacking the integrity of a tire carcass at its strongest point.

It has been determined that the cutters as disclosed herein are capable of repeated of accurate disposing of tire carcasses without any noticeable hogging or jamming. The construction of the main cutter surfaces, the knife edges, the button cutters 30, and the punch cutter face inserts 54 as removable, replaceable items makes it easy to maintain the cutters in a sharp condition at all times and thus wear does not have a deleterious effect upon the cutter.

This is particularly important inasmuch as it is known that the typical reinforced rubber material used in tire carcasses, especially truck tire carcasses, is an extraordinarily abrasive substance, and jamming and wear have been a noted problem in the prior art structures.

The invention as claimed is of the particular two part cutter structure disclosed above and as, disclosed is not restricted to the particular embodiment shown but rather to that wider range of equivalents as are inherent in the claims.

Most notably, any motive force for the activation of the die and cutter is suitable so long as the anvils are not mechanically locked into position and so long as it is capable of producing a first high pressure on the anvils, sufficient to collapse an enclosed tire carcass and a second higher pressure upon the punches sufficient to drive the punches through the tire carcass into the die. Therefore, while the preferred test embodiment has used hydraulic pressure, pneumatic pressure has also been used with some success. Presumably some form of flexible mechanical drive might also be sufficient provided that no locking of the anvils would occur.

I claim:

1. An apparatus for reducing a reinforced matrix material to small disposable parts comprising:

a plurality of adjoining punch and die means, each further comprising:

a female die having a plurality of spaced peripheral penetrating cutting means extending to form a upper matrix cutter;

said female die having shearing means interposed between each penetrating cutting means;

a male punch sized to said female die having an operating position withdrawn from said female die and a cutting position extended through said female die;

a moveable anvil, opposed to said male punch for clamping the matrix material against said male punch;

means for driving said male punch through said female die, said male punch cooperatively with said anvil clamping the matrix material, shearing said material against said female die.

2. The apparatus of claim 1 wherein each said adjoining punch and die means further comprises:

each said female die further comprising a regular geometric opening defined by a plurality of sides, said sides adjoining to form vertices thereof;

each said penetrating cutting means further comprising a pointed cutting knife edge extending from each said side in a direction proximate said punch means;

each said shearing means further comprising a hardened shearing insert at each said vertex;

each said male punch being shaped in cross section to said regular geometric shape;

each said punch having a shearing face cooperatively mating against all the knife edges and all the shearing inserts of the female die for cutting.

3. The apparatus of claim 1 above, wherein said moveable anvil further comprises:

anvil means matingly journaled within said die means, facingly opposing said punch;

said anvil means having a first operative position withdrawn behind said female die and a second operating position extended through said female die beyond the penetrating cutting means thereof.

4. The apparatus of claim 3 above further comprising:

first actuating means for actuating said anvil means from said first operative position to said second operative position with a material clamping pressure;

second actuating means for actuating said punch reciprocally against said anvil means with a cutting pressure;

said cutting pressure being greater than said material clamping pressure.

5. An apparatus for cutting a reinforced matrix material comprising:

a female die assembly comprising a plurality of regular geometric openings each defining sides and vertices thereof;

a pointed vertical knife edge extending from each said side to a point above said female die;

said vertices further defining a shearing means of said female die assembly;

a reciprocating male punch assembly, of a shape having an interference, shearing fit through said female die assembly;

a reciprocating, material clamping anvil assembly facing, opposed to said punch assembly;

a first actuating means for activating said material anvil assembly against said punch assembly with a first pressure;

said punch assembly and said anvil assembly clamping a matrix material with said first pressure;

second actuating means for driving said punch assembly, said material, and said anvil assembly, clamped together with said first pressure, through said female die assembly.

6. A cutter for sectioning a reinforced flexible material into disposable pieces comprising:

a female die having penetrating cutting means projecting forward of shearing means;

male punch means cooperatively mating with said female die for shearing a material against said female die; and anvil means, facingly opposed to said male punch means, cooperatively engaged therewith for compressing a material to be cut against said male punch means during the activation of said male punch means through said female die.

7. An apparatus for sectioning a reinforced, flexible material of the type having a flexible matrix within which is embedded a knife edge resistant reinforcing means comprising:

means for clamping said reinforced material to be sectioned, said means for clamping, driving said material against knife cutter means for piercingly cutting said matrix; and against shearing means for shearing said knife edge resistant reinforcing means;

said knife cutter means and said shearing means further jointly comprise:

a female die means having straight sides, the straight sides jointed at vertices thereof;

said knife cutter means comprising pointed knife edges forming the straight sides of said die;

said shearing means comprising hardened inserts forming the vertices of said die.

8. The apparatus of claim 7 further comprising:

means for forcing said material through said die, said means forcing said material sequentially against said knife cutter prior to said shearing means.

9. The apparatus of claim 7 further comprising:

said clamping means holding said material as a tensioned sheet;

said clamping means in sequence forcing said material against said knife cutter means prior to forcing said material against said shearing means.

10. The apparatus of claim 7 wherein said clamping means further comprises:

punch means for sectioning said material cooperatingly with said knife cutter and said shearing means;

anvil means facingly opposed to said punch means, movable with respect to said punch means; and means for clamping said material between said punch means and said anvil means.

* * * * *